US005967688A

United States Patent [19]

Hu

[11] Patent Number: 5,967,688

[45] Date of Patent: Oct. 19, 1999

[54] WRITING APPARATUS

[75] Inventor: James Hu, Shin-Tien, Taiwan

[73] Assignee: Pro Eton Corporation, Shin-Tien, Taiwan

[21] Appl. No.: 08/984,644

[22] Filed: Dec. 3, 1997

Related U.S. Application Data

[63] Continuation-in-part of application No. 08/918,009, Aug. 27, 1997, abandoned.

[51] Int. Cl.[6] ..... B43K 8/04; B43K 27/00

[52] U.S. Cl. ..... 401/206; 401/34; 401/219; 401/273

[58] Field of Search ..... 401/206, 219, 401/273, 34

[56] References Cited

U.S. PATENT DOCUMENTS 4,792,252 12/1988 Kremer et al. ..... 401/206

FOREIGN PATENT DOCUMENTS 60-90160 6/1985 Japan ..... 401/206
532235 4/1987 Japan ..... 401/206

*Primary Examiner*—Steven A. Bratlie
*Attorney, Agent, or Firm*—Bacon & Thomas, PLLC

[57] ABSTRACT

A writing apparatus which includes a pen holder holding an ink, a pen socket fastened to an open end of the pen holder and holding a sponge and an absorptive writing tip, an ink feeding valve assembly mounted in the pen holder and adapted to feed the ink to the sponge and the absorptive writing tip, and a steel ball movable in the ink inside the pen holder, the steel ball being movable by the pressure of the ink to close off a tapered rear opening on the ink feeding valve assembly and to stop the ink from passing to the inside of the ink feeding valve assembly when the pen holder is held in a writing position, and the steel ball being movable away from the tapered rear opening on the ink feeding valve assembly for permitting the ink to pass from the pen holder to the inside of the ink feeding valve assembly when the pen holder is placed in a horizontal position.

4 Claims, 6 Drawing Sheets

WRITING APPARATUS

BACKGROUND OF THE INVENTION (a) Field of the Invention

The present invention is a continuation in part of application Ser. No. 08/918,009, filed on Aug. 27, 1997 and now abandoned, and it relates to writing apparatus, and more particularly to such a writing apparatus which feeds the ink quantitatively to prevent an overflow of the ink.

(b) Description of the Prior Art

Regular ink feeding writing apparatus are generally grouped into two types, the direct ink-feeding type and the ink-absorptive core type. A fountain pen is a direct ink-feeding type writing apparatus having a valve means to adjust the flow rate of ink. However, this valve means cannot positively control the flow rate of ink, and ink tends to spill from the feed tube. An ink-absorptive core type writing apparatus uses an absorptive core to absorb ink, permitting ink to permeate from the absorptive core to a front writing tip for writing. However, because the absorptive core can only hold a limited amount of ink, the service life of this type of writing apparatus is short.

SUMMARY OF THE INVENTION

The present invention provides a writing apparatus which eliminates the aforesaid drawbacks. According to one aspect of the present invention, the writing apparatus comprises an ink feeding valve assembly adapted to feed ink to the writing tip, and a steel ball adapted to control the ink passage between the ink reservoir and the ink feeding valve assembly. The ink feeding valve assembly is comprised of a front valve block, a rear valve block, and a piston coupled between the front valve block and the rear valve block. When the writing tip of the writing apparatus is pressed against paper during writing, the piston is moved backwards from the front valve block for permitting ink to flow to the writing tip through a sponge. When the writing tip is removed from the paper, the piston is returned to its former position to stop the supply of ink to the writing tip. According to another aspect of the present invention, a steel ball is movable in the ink. When writing, the steel ball closes off a tapered rear opening on the rear valve block of the ink feeding valve assembly to stop ink from passing to the inside of the ink feeding valve assembly, and therefore no excessive amount of ink is allowed to pass to the writing tip during writing. According to still another aspect of the present invention, when the user shakes the pen holder, the steel ball is forced out of the tapered rear opening on the rear valve block, and ink is allowed to pass from the pen holder to the inside of the ink feeding valve assembly again.

DETAILED DESCRIPTION OF THE PREFERRED EMBODIMENTS

Figure 1:
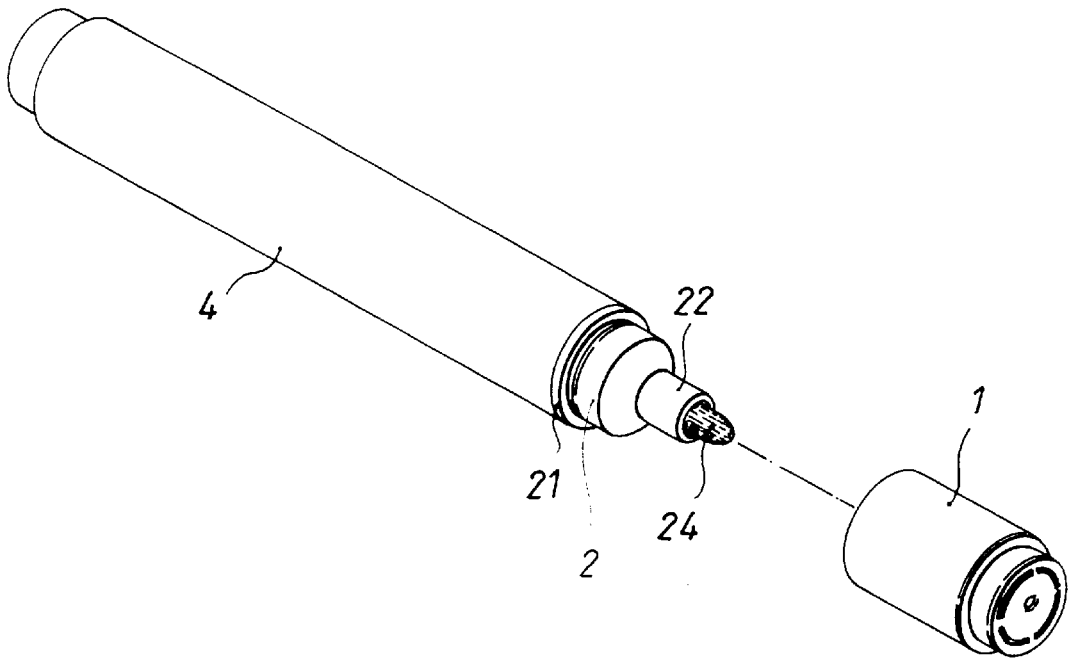
FIG. 1 is a perspective view of a writing apparatus according to one embodiment of the present invention.

Referring to FIG. 1, a writing apparatus in accordance with the present invention is generally comprised of a pen cap 1, a pen socket 2, an ink feeding valve assembly 3, and a pen holder 4.

Figure 2:
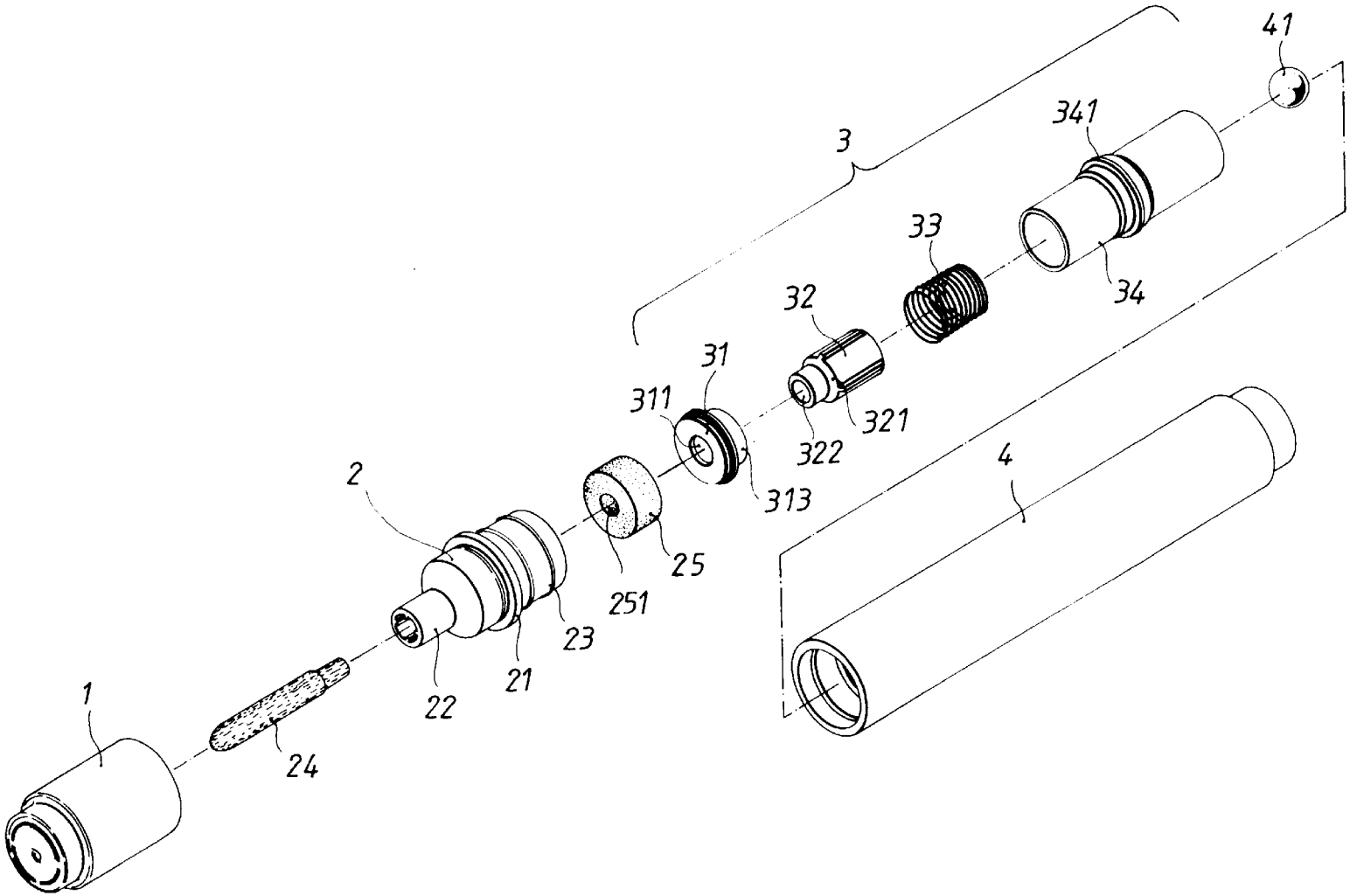
FIG. 2 is an exploded view of the writing apparatus shown in FIG. 1.
Figure 3:
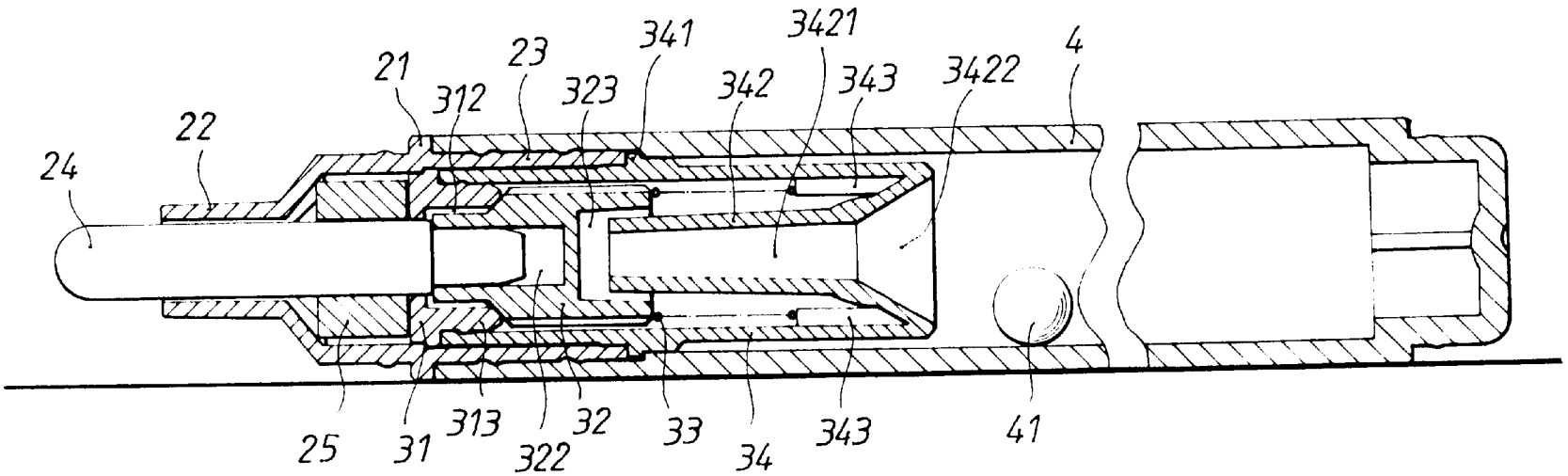
FIG. 3 is a longitudinal view in section of the writing apparatus shown in FIG. 1.

Referring to FIGS. 2 and 3 and FIG. 1 again, the pen socket 2 is a stepped socket holding a sponge 25 on the inside and an absorptive writing tip 24 at its front side, and comprising an annular flange 21 raised around the periphery on the middle, a tubular rear coupling portion 23, and a front neck 22. The sponge 25 has an axial center through hole 251. The absorptive writing tip 24 is inserted through the axial center through hole 251 on the sponge 25, and partially extends out of the front neck 22 of the pen socket 2.

The pen cap 1 is detachably engagable on the front side of the pen socket 2 to protect the absorptive writing tip 24.

The ink feeding valve assembly 3 is comprised of a front valve block 31, a piston 32, a return spring 33, and a rear valve block 34. The front valve block 31 is mounted in the tubular rear coupling portion 23 of the pen socket 2 and disposed in engagement against the sponge 25, and includes a rear annular extension flange 313, a rear open chamber 312 defined within the rear annular extension flange 313, and an axial center through hole 311 through the rear open chamber 312. The piston 32 is a hollow cylindrical member having a front annular cone-shaped portion 321, and a front neck 322 extending forwardly from the portion 321. The front neck 322 of the piston 32 is inserted into the rear open chamber 312 of the front valve block 31 and sleeved onto the rear end of the absorptive writing tip 24. The rear valve block 34 is a tubular member comprising an annular flange 341 extending around its middle periphery, an inner tube 342 extending forwardly from its rear side and defining a longitudinal center through hole 3421, a tapered rear opening 3422 at the rear side in communication with the longitudinal center passageway 3421 (the diameter of the tapered rear opening 3422 gradually increases toward the rear), and an annular stop flange 343 extending forwardly from the inside of the inner tube 342. The return spring 33 is mounted around the inner tube 342 within the rear valve block 34, and engages between the stop flange 343 and the piston 32.

The pen holder 4 is a cylindrical member having an open front end mounted on the tubular rear coupling portion 23 of the pen socket 2. The pen holder 4 holds an ink supply, and a steel ball 41 is disposed in the ink.

When the ink feeding valve assembly 3 is assembled, it is mounted in the tubular rear coupling portion 23 of the pen socket 2 with the front valve block 31 coupled to the rear end of the absorptive writing tip 24 and disposed in engagement against the sponge 25, permitting the annular flange 341 of the rear valve block 34 to engage against a rear annular ledge of the pen socket 2, and then the pen holder 4 is coupled to the tubular rear coupling portion 23 of the pen socket with its front periphery edge in engagement with annular flange 21, and thereafter sealed.

Figure 4:
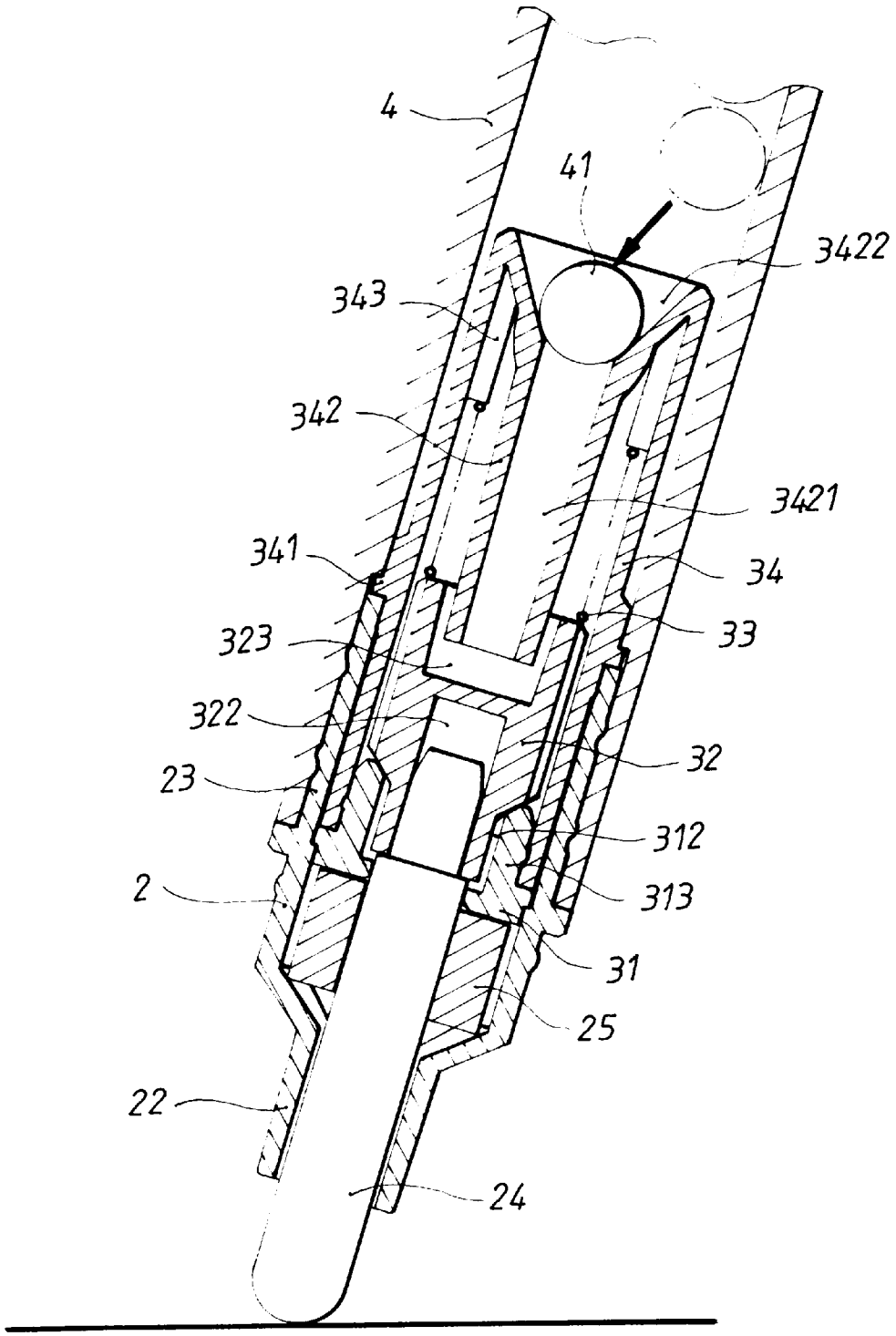
FIG. 4 is a sectional view of the present invention, showing the writing apparatus held in a writing position, and the steel ball moved to the tapered rear opening on the rear valve block.
Figure 5:
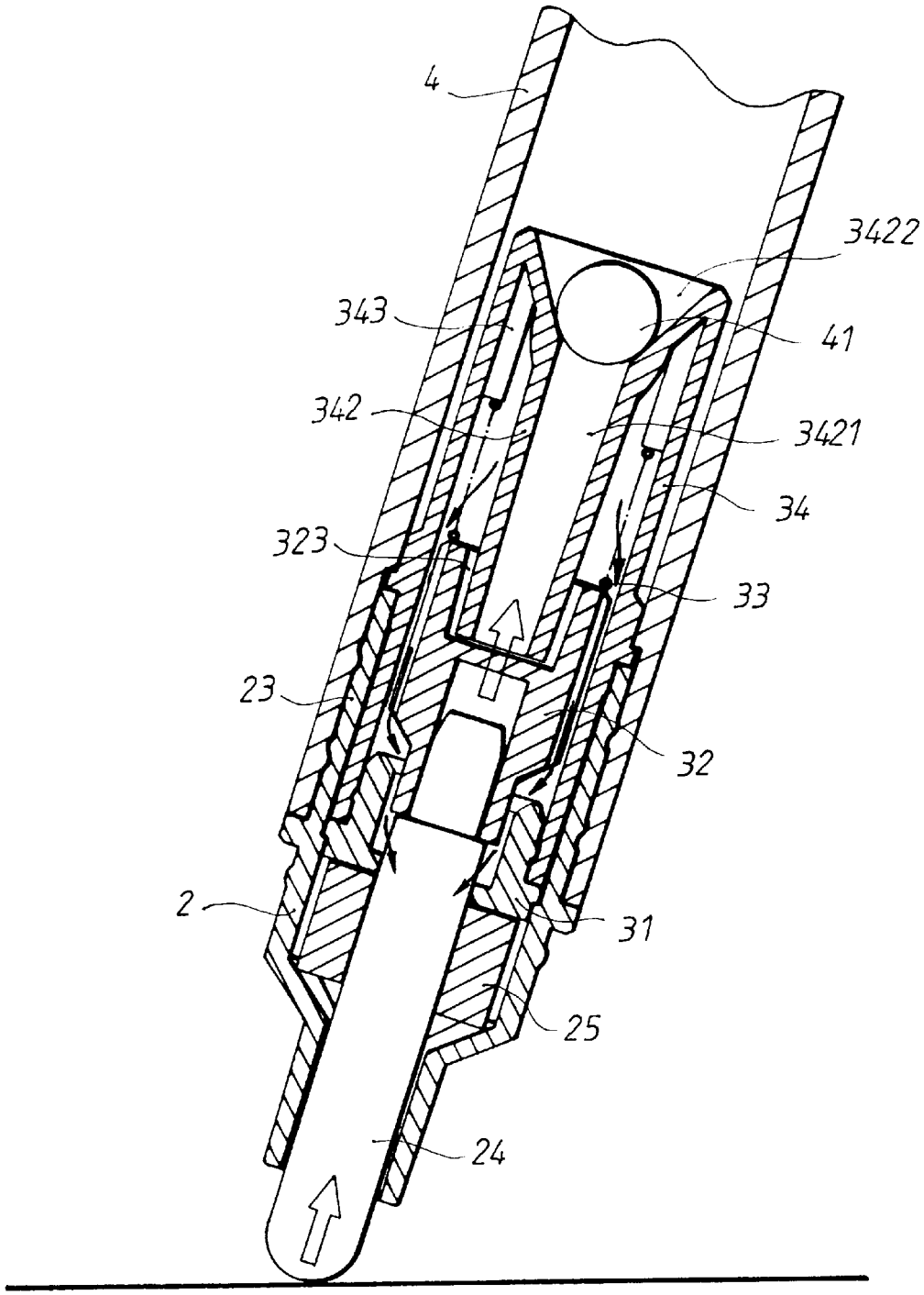
FIG. 5 is similar to FIG. 4 but shows the absorptive writing tip forced backwards, and the piston moved away from the front valve block.

Referring to FIGS. 4 and 5, the steel ball 41 is movable in the ink inside the pen holder 4. When the writing apparatus is placed in a horizontal position, the steel ball 41 is moved out of the tapered rear opening 3422, for permitting the ink to flow from the pen holder 4 into the ink feeding valve assembly 3. When the writing apparatus is held in a writing position with the absorptive writing tip 24 pressed against paper, the piston 32 is moved backwards from the front valve block 31, permitting the ink to pass into the gap between the piston 32 and the front valve block 31 and to be absorbed by the sponge 25 and the absorptive writing tip 24 for writing. During writing, the pen holder 4 is held in a vertical or tilted position, and the steel ball 41 is forced by the pressure of the ink to close the tapered rear opening 3422 and stop the ink from passing to the ink feeding valve assembly 3, and at the same time the ink inside the ink feeding valve assembly 3 is forced by its pressure to permeate through the sponge 25. When the ink in the ink feeding valve assembly 3 is used up, the pen holder 4 is shaken with the hand and put in a horizontal position for a while, permitting the ink to pass from the pen holder 4 to the ink feeding valve assembly 3 again.

Figure 6:
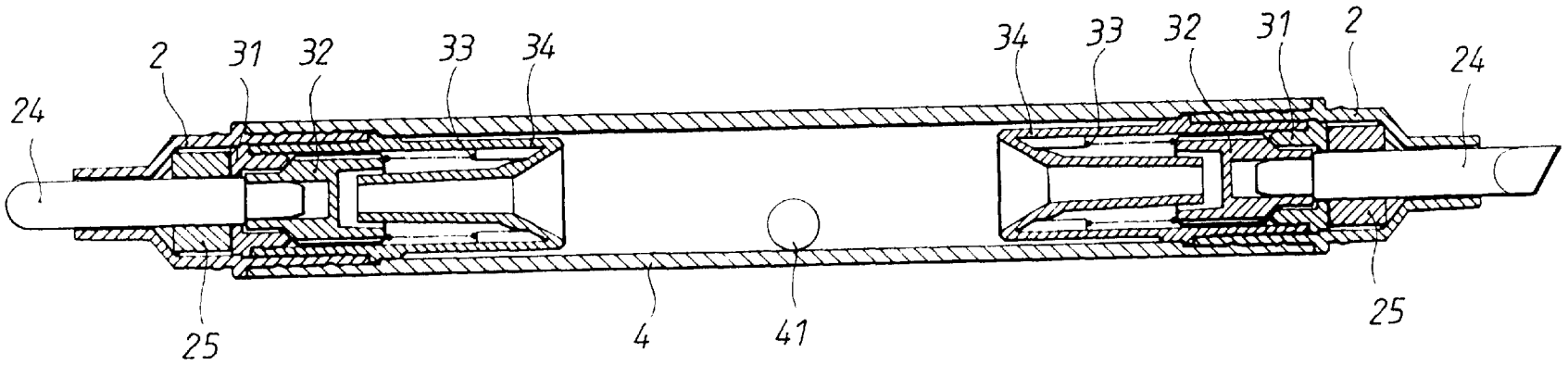
FIG. 6 is a sectional view of an alternate embodiment of the writing apparatus according to the present invention.

FIG. 6 shows an alternate form of the present invention, in which the pen holder 4 has two open ends, each being mounted with a respective ink feeding valve assembly 3 and a respective pen socket 2, and the steel ball 41 is movable to alternatively close/open the respective ink feeding valve assemblies 3 at both ends.

It is to be understood that the embodiments of the invention described herein are for purposes of illustration only, and are not intended as a definition of the limits and scope of the disclosed invention.

What the invention claimed is:

1. A writing apparatus comprising:

a pen holder for holding an ink supply;

a pen socket fastened to one end of said pen holder and containing a sponge and an absorptive writing tip at a front side thereof, said absorptive writing tip having a rear end inserted through an axial center through hole of said sponge and a front end extending out of a front neck on said pen socket;

a pen cap for covering said pen socket to protect said absorptive writing tip;

an ink feeding valve assembly mounted inside said pen holder for feeding ink to said sponge and said absorptive writing tip, said ink feeding valve assembly comprising a front valve block mounted in said pen socket and disposed in engagement against said sponge, said front valve block having a rear annular extension flange, a rear open chamber defined within said rear annular extension flange, and an axial center hole through said rear open chamber for receiving the rear end of said absorptive writing tip, a tubular piston having a front neck inserted into the rear open chamber of said front valve block and sleeved onto the rear end of said absorptive writing tip, a tubular rear valve block mounted around said piston, said tubular rear valve block comprising an inner tube extending forwardly through the rear valve block from a rear side thereof and defining a longitudinal center passageway and a tapered rear opening at the rear side in communication with the longitudinal passageway of said inner tube, and a return spring mounted around said inner tube within said rear valve block and engaging said piston for urging said rear valve block rearwardly relative to said piston; and a steel ball movable in the ink inside said pen holder, said steel ball being movable by the pressure of the ink to close off the tapered rear opening on said rear valve block and to stop the ink from passing to the inside of said ink feeding valve assembly when said pen holder is held in a substantially vertical writing position, said steel ball being further movable away from the tapered rear opening on said rear valve block for permitting the ink to pass from said pen holder to the inside of said ink feeding valve assembly when said pen holder is placed in a horizontal position.

2. A writing apparatus comprising:

a pen holder for holding an ink supply, the pen holder including a pair of opposite ends;

a pair of pen sockets respectively fastened to said opposite ends of said pen holder, each socket containing a sponge and an absorptive writing tip at a front side thereof, each absorptive writing tip having a rear end inserted through an axial center through hole of the sponge and a front end extending out of a front neck on the pen socket;

a pair of pen caps for covering said pen sockets to protect the respective absorptive writing tips;

an ink feeding valve assembly mounted inside each pen holder for feeding ink to the sponges and absorptive writing tips at both ends of said pen holders, each of said ink feeding valve assemblies comprising a front valve block mounted in said pen socket and disposed in engagement against the sponge, each front valve block having a rear annular extension flange, a rear open chamber defined within said rear annular extension flange, and an axial center hole through said rear open chamber for receiving the rear end of the absorptive writing tip, a tubular piston having a front neck inserted into the rear open chamber of each front valve block and sleeved onto the rear end of the corresponding absorptive writing tip, a tubular rear valve block mounted around each piston, each tubular rear valve block comprising an inner tube extending forwardly from a rear side thereof and defining a longitudinal center passageway and a tapered rear opening at the rear side in communication with the longitudinal passageway of said inner tube, and a return spring mounted around the inner tube within each rear valve block for urging the rear valve block rearwardly relative to the piston; and a steel ball movable in the ink inside each pen holder to alternatively close off and open the tapered rear openings of the rear valve blocks of said ink feeding valve assemblies.

3. The writing apparatus of claim 1, wherein said rear valve block further includes an annular stop flange engaged by said return spring.

4. The writing apparatus of claim 2, wherein each rear valve block of each of said ink feeding valve assemblies further includes an annular stop flange engaged by the return spring.

* * * * *